US006389721B1

(12) United States Patent
Yang

(10) Patent No.: US 6,389,721 B1
(45) Date of Patent: May 21, 2002

(54) FOLDABLE SAFETY SIGN

(76) Inventor: Chin-Lai Yang, No. 257, Hsing-Her Road, Dah-Duh Shiang, Taichung Hsien (TW), 432

( * ) Notice: Subject to any disclaimer, the term of this patent is extended or adjusted under 35 U.S.C. 154(b) by 0 days.

(21) Appl. No.: 09/859,596

(22) Filed: May 18, 2001

(51) Int. Cl.[7] ..... G09F 15/00

(52) U.S. Cl. ..... 40/610; 40/612; 40/903; 116/63 T

(58) Field of Search ..... 40/612, 610, 903, 40/606; 116/63 T, 63 D, 63 P; 340/473; 403/52, 54, 102

(56) References Cited

U.S. PATENT DOCUMENTS 2,074,102 A * 3/1937 Christy ..... 403/54
5,078,348 A * 1/1992 Babitchenko ..... 248/124
5,924,228 A * 7/1999 Yang ..... 40/610

* cited by examiner

*Primary Examiner*—Cassandra H. Davis
(74) *Attorney, Agent, or Firm*—Rosenberg, Klein & Lee

(57) ABSTRACT

A foldable safety sign includes a base and a sign member. The sign member can either be fold and slide when mounted on the base or detached from the base. Accordingly, the store length of the foldable safety sign is much shorter.

6 Claims, 8 Drawing Sheets

FOLDABLE SAFETY SIGN

BACKGROUND OF THE INVENTION

1. Field of the Invention

The present invention relates to a foldable safety sign, and more particularly to a sign member which can either be fold and slide when mounted on the base or can be detached from the base.

2. Description of the Related Prior Art

A conventional safety sign is disclosed in U.S. Pat. No. 5,924,228 including a base and a sign member. The sign member of this safety sign contains four arms which will totally be pivotally moved downward resulting in a longer store length.

SUMMARY OF THE INVENTION

However, it is found a disadvantage in the subject matter of the conventional foldable safety arm that the store length is still too long.

Thus, there is still a need for improving the subject matter of prior art in terms of providing a foldable safety sign with shorter store length.

Therefore, an object of the present invention is to provide a foldable safety sign which has a shorter foldable length.

To accomplish the object of the present invention, a foldable safety sign includes a base and a sign member. The base includes a base frame, multiple feet pivotally mounted on an underside side of the base frame, a hollow container mounted on the base frame on one side opposite to the side the feet mounted, and a post having one end slidably contained in the container. The sign member includes a coupler detachably secured on the post of the base, arms including at least a first arm, a second arm, a third arm and a fourth arm each made of light reflecting material, the first and the second arms each having one end pivotally connected to the coupler, links including at least a first link and a second link, the first and the second link s each pivotally connected to an end of the first arm and the second arm opposite to the end connected to the coupler and each pivotally connected to one end of the third and the fourth arms, and a slide pivotally connected to an end of the third and the fourth arms opposite the end connected to the links, respectively. The slide contains a fender extending from the side facing to the coupler and toward the third and the fourth arms.

BRIEF DESCRIPTION OF THE DRAWINGS

The other advantages and/or benefits caused by the present invention will become patently apparent after reading the following detailed description of an illustrative preferred embodiment of the invention together with referring to the associated drawings in which.

DETAILED DESCRIPTION OF THE PREFERRED EMBODIMENT

Figure 1:
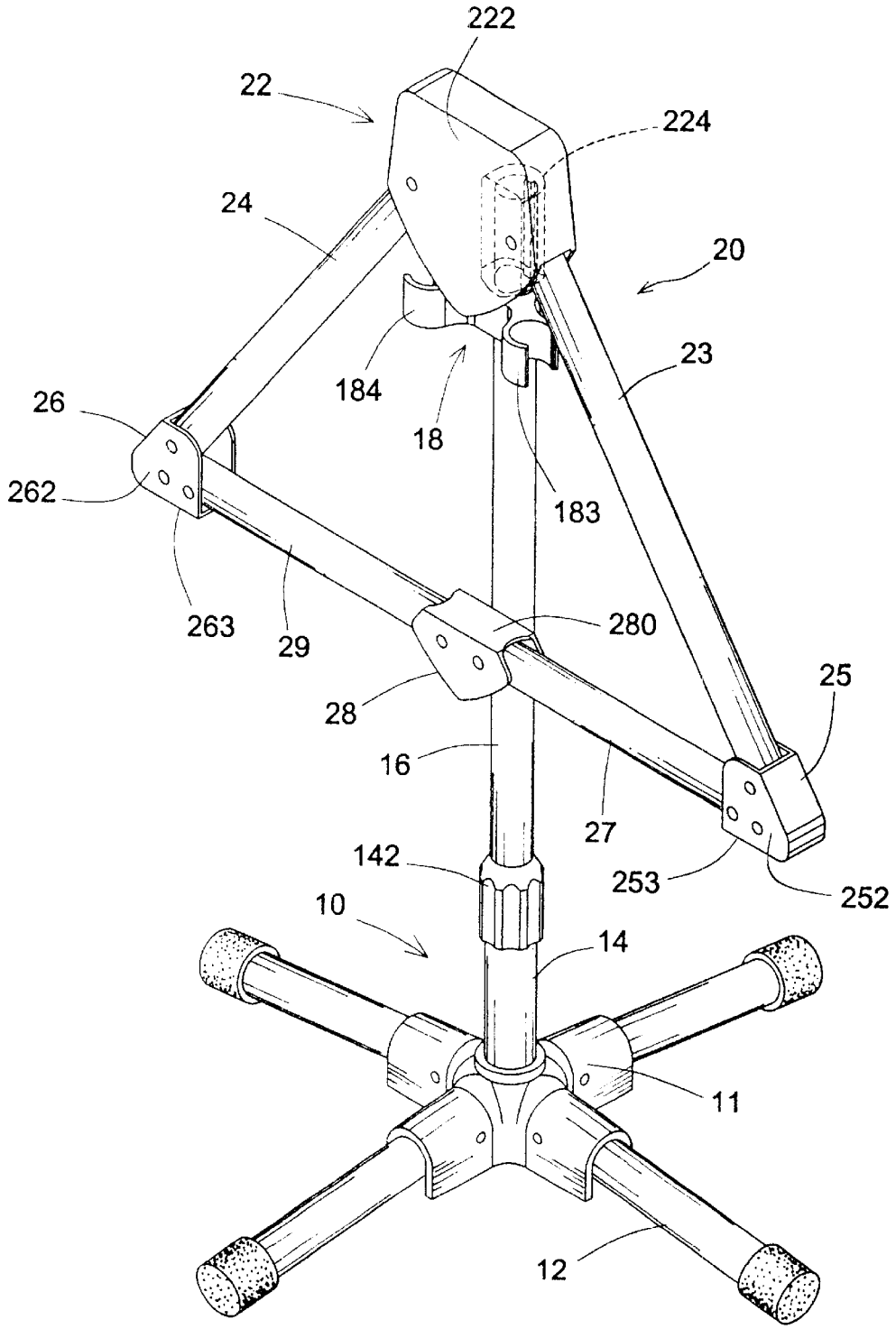
FIG. 1 is a perspective view of a preferred embodiment of a foldable safety sign in accordance with the present invention.
Figure 2:
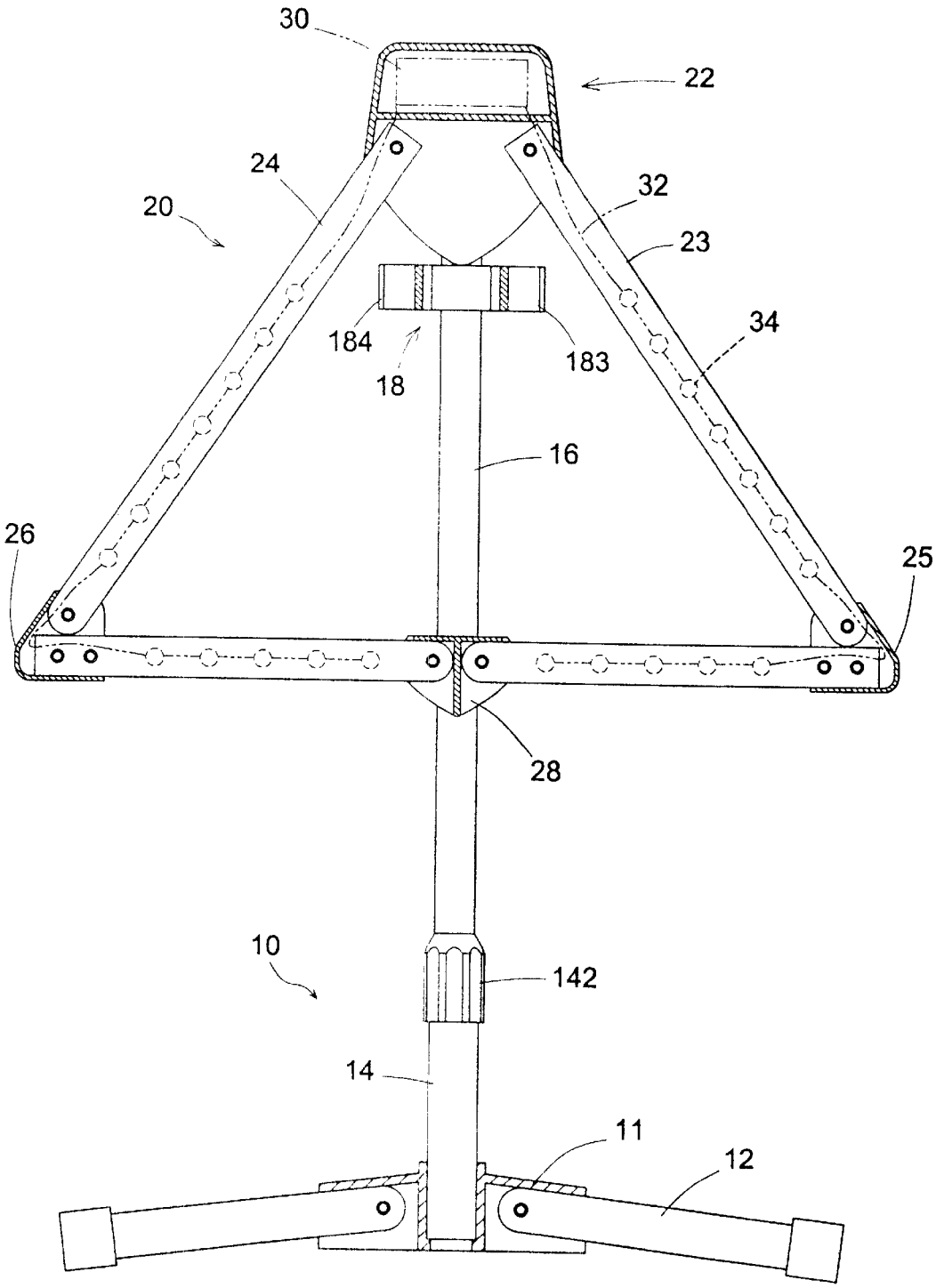
FIG. 2 is a front view of the preferred embodiment of a foldable safety sign in accordance with the present invention.
Figure 3:
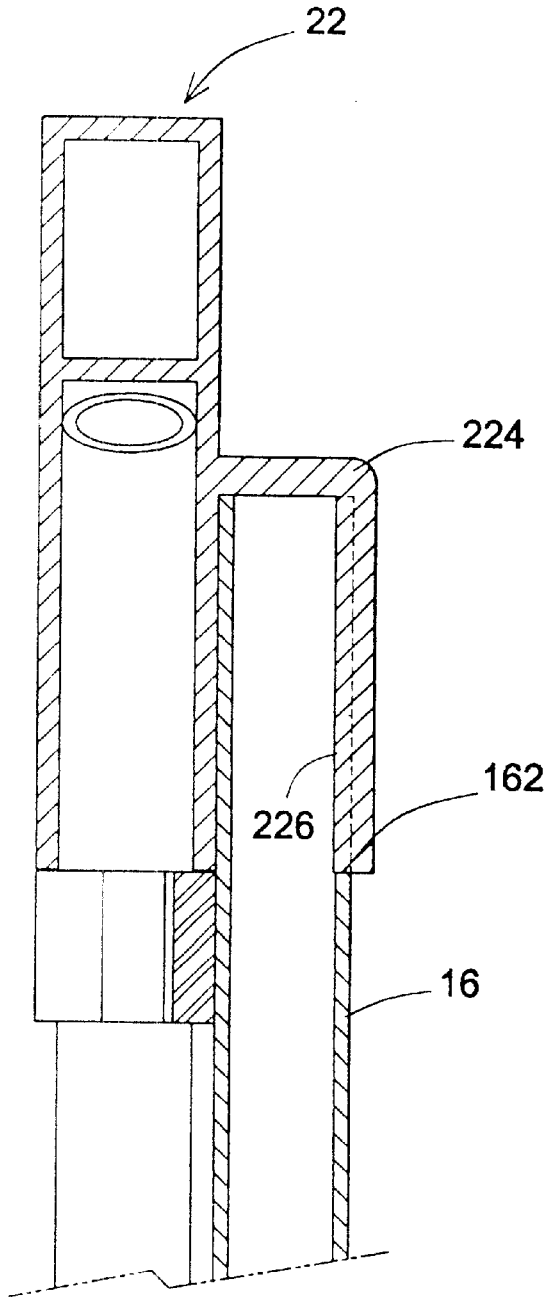
FIG. 3 is a side view of the preferred embodiment of a foldable safety sign in accordance with the present invention.

With reference to FIGS. 1, 2 and 3, a preferred embodiment of a foldable safety sign in accordance with the present invention includes a base 10 and a sign member 20.

The a base (10) includes a base frame (11), multiple feet (12), a container (14) and a post (16).

The base frame (11) is crucial in this embodiment and the under portions each of the limbs of it are partial cut off.

The multiple feet (12) are pivotally mounted on an underside side of the base frame (11), respectively.

The container (14) is a hollow short tube in this embodiment and is mounted on the base frame (11) on one side opposite to the side the feet (12) mounted.

The post (16) is a tube and is of smaller size in diameter than that of the container (14). Thus, one end of the post (16) is slidably contained in the container (14). Further more, an adjustable means can be used to adjust the height of the post (16) when its end is contained in the container (14).

More particularly, the base (10) further includes a hollow connector cylinder (142) on atop portion of the container (14) to allow the post (16) to pass through. In this case, the top portion of the container (14) is threaded and the inner side of the connector cylinder (14) is correspondingly threaded, too.

Furthermore, the post(16) of the base (10) has a retainer (18) fastenedly mounted on the end of the post (16).

Figure 4:
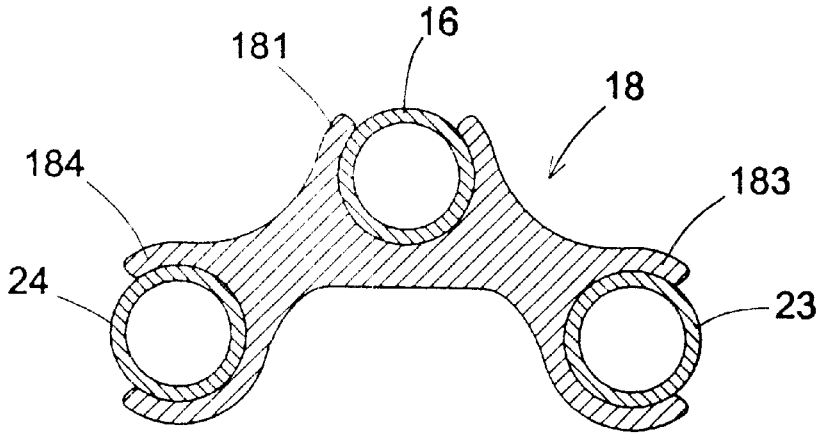
FIG. 4 is a cross-section view of a retainer in the preferred embodiment of a foldable safety sign in accordance with the present invention.

More particularly, referring to FIG. 4, the retainer (18) includes a middle sleeve (181) defined on a central portion thereof for locking the post (16) and a first and a second side sleeves (183, 184) respectively defined on a side adjacent to the middle sleeve (181) for locking the sign member (20).

The middle sleeve (181), further referring to FIG. 4, is C-like and the two side sleeves(183, 184) are C-like in cross-section. All the sleeves (181,183, 184) have an opening defined opposite to the central portion of the retainer (18).

Referring to FIGS. 1,2 and 3, the sign member (20) includes a coupler (22), at least four arms (23, 24,27,29), multiple link (25,26), and a slide (28).

The coupler (22) is detachably secured on the post (16) of the base (10) so that the sign member (20) is detachably mounted to the base (10).

The four arms includes a first arm (23), a second arm (24), a third arm (27) and a fourth arm (29). All arms (23,24,27, 29) are made of light-reflecting material. The first and the second aims (23, 24) each have one end pivotally connected to the coupler (22).

The links (25,26) includes at least a first link (25) and a second link (26). The first and the second links (25,26) are respectively, pivotally connected to an end of the first arm (23) and the second arm (24) opposite to the end connected to the coupler (22). The links (25,26) further pivotally connected to one end of the third and the fourth arms (27, 29). The first link and the second link (25,26) further have a fender (253,263) protruding from a side facing the base (10) and toward the third and the fourth arms (27,29).

The slide (28) is pivotally connected to an end of the third and the fourth arms (27,29) opposite the end connected to the links (25,26), respectively. The slide (28) includes a fender (280) protruding from a side facing the coupler (22) and toward the third and the fourth arm (27, 29). Accordingly, when the first and the second arms (23,24) are pivotally moved downward by the gravity, the third and the fourth arms (27, 29) can be sustained horizontally.

Figure 5:
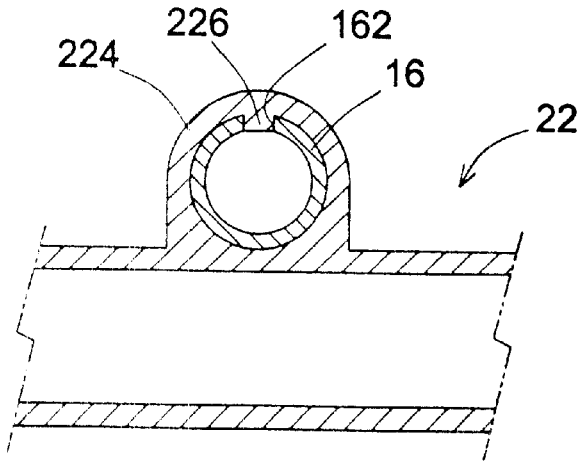
FIG. 5 is a cross-section view of a container in the preferred embodiment of a foldable safety sign in accordance with the present invention.

Referring to FIGS. 1 and 5, more particularly, the post (16) has an end extending toward the coupler (22) and the coupler (22) has a connecting tube (224) defined in an inner side thereof This end of the post (16) defines a slot (162) and the connecting tube (224) has a connecting rib (226) protruding from a position corresponding to the slot (162) of the post (16) to allow the rib (226) to be locked in the slot (162).

More particularly, the first link (25) and the second link (26) respectively have a fender (253, 263) protruding from a side facing the base (10) and toward the third and the fourth arms (27, 29).

Moreover, the coupler (22) may have a power source (30) mounted therein. The multiple arms (23,24,27,29) are electrically connected to the power source (30), for example, by wire (32). Multiple light emitting devices (34) are mounted in the multiple arms (23,24,27,29) and electrically connected to the power source (30). Furthermore, the coupler (22) further contains an IC board (not shown) electrically connected to the power source (30). The power source (30) can be embodied, for example, by a battery or the vehicle power source.

Figure 6:
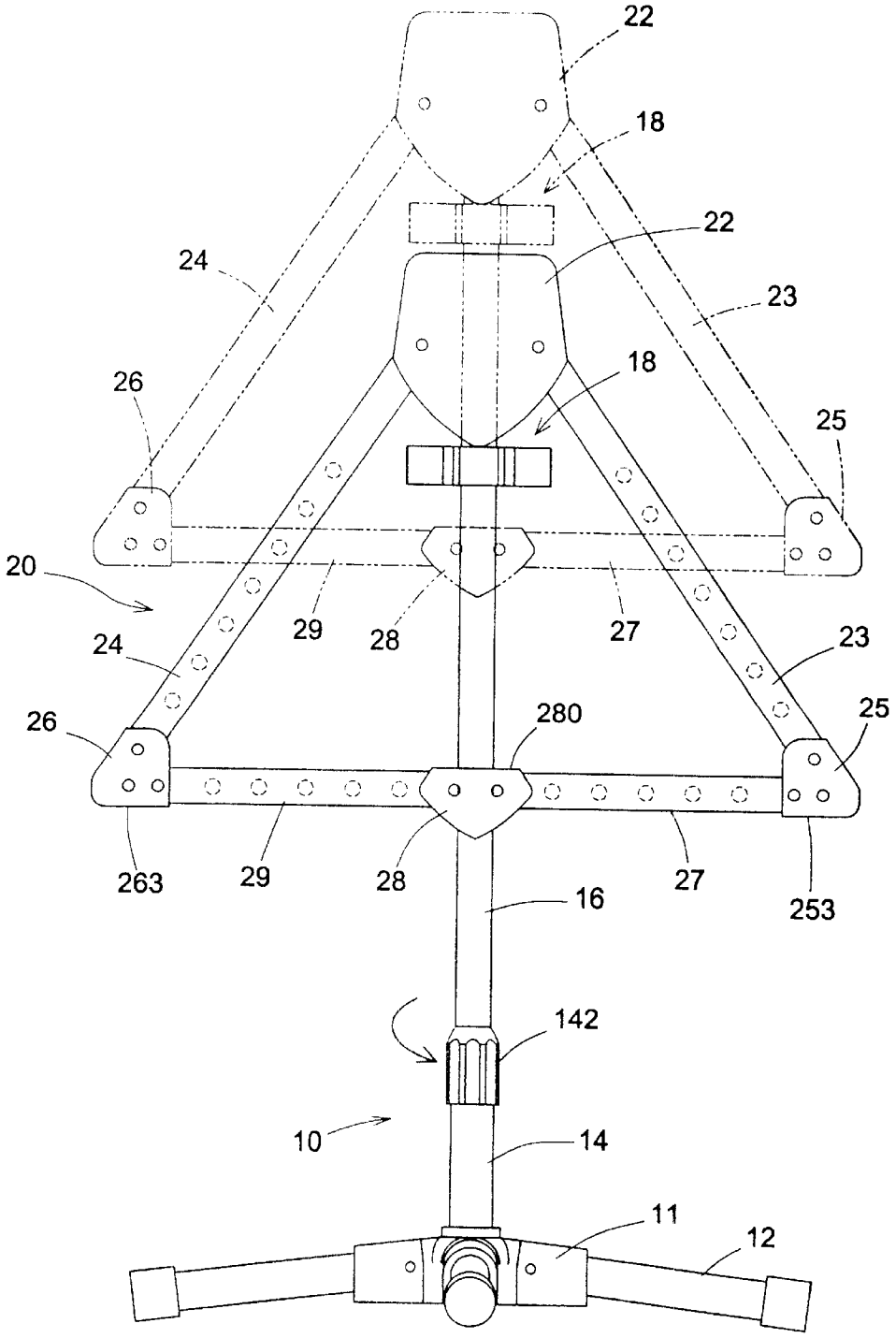
FIG. 6 is a schematic view showing the use of the preferred embodiment of a foldable safety sign in accordance with the present invention.

Referring to FIG. 6, in case that the height of the sign member (20) is desired to be adjusted, the connector cylinder (142) is allowed to be rotated so that the post (16) can freely slide through container (14).

Figure 7:
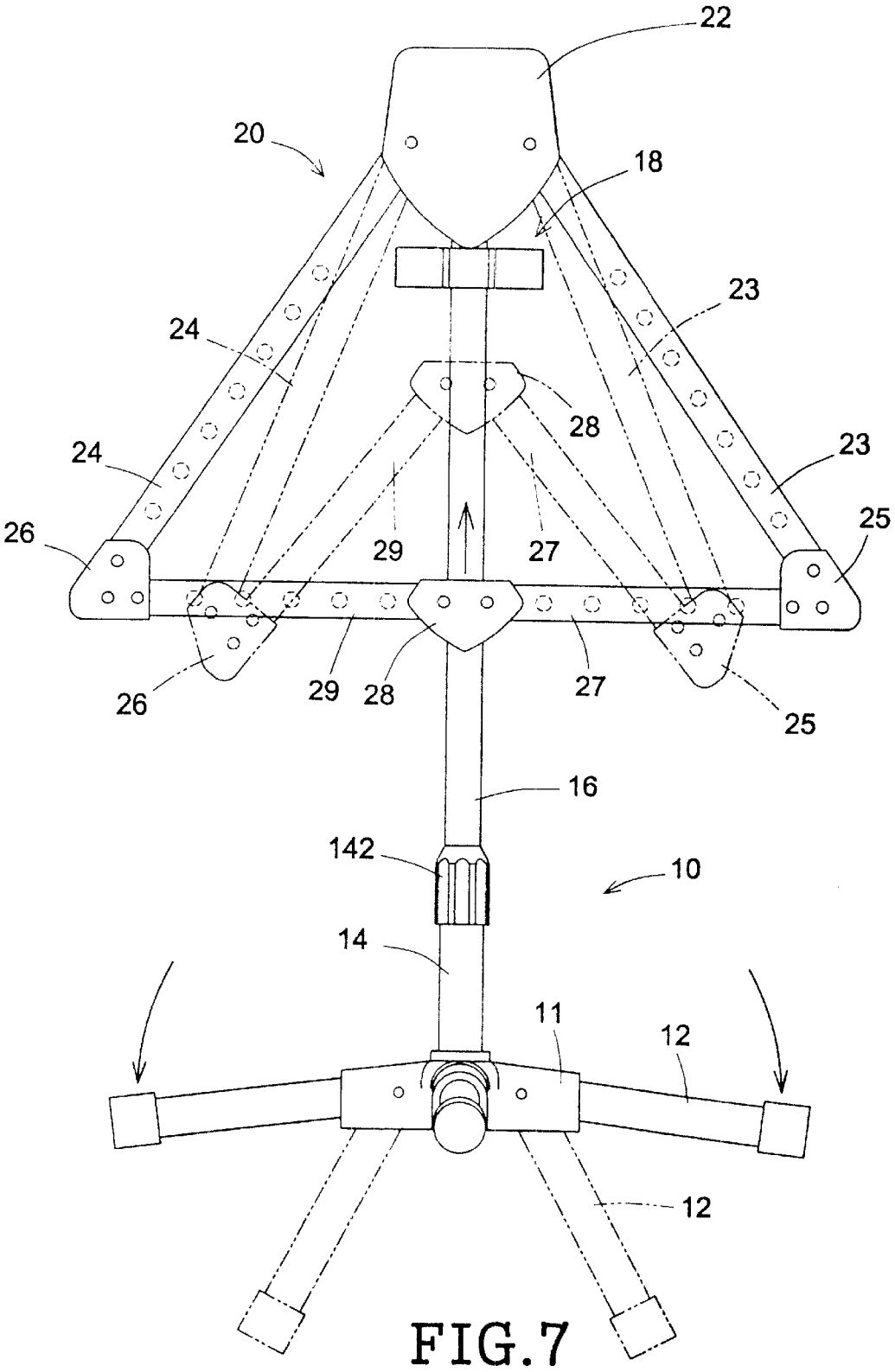
FIG. 7 is a schematic view showing the preferred embodiment of a foldable safety sign in accordance with the present invention when fold.
Figure 8:
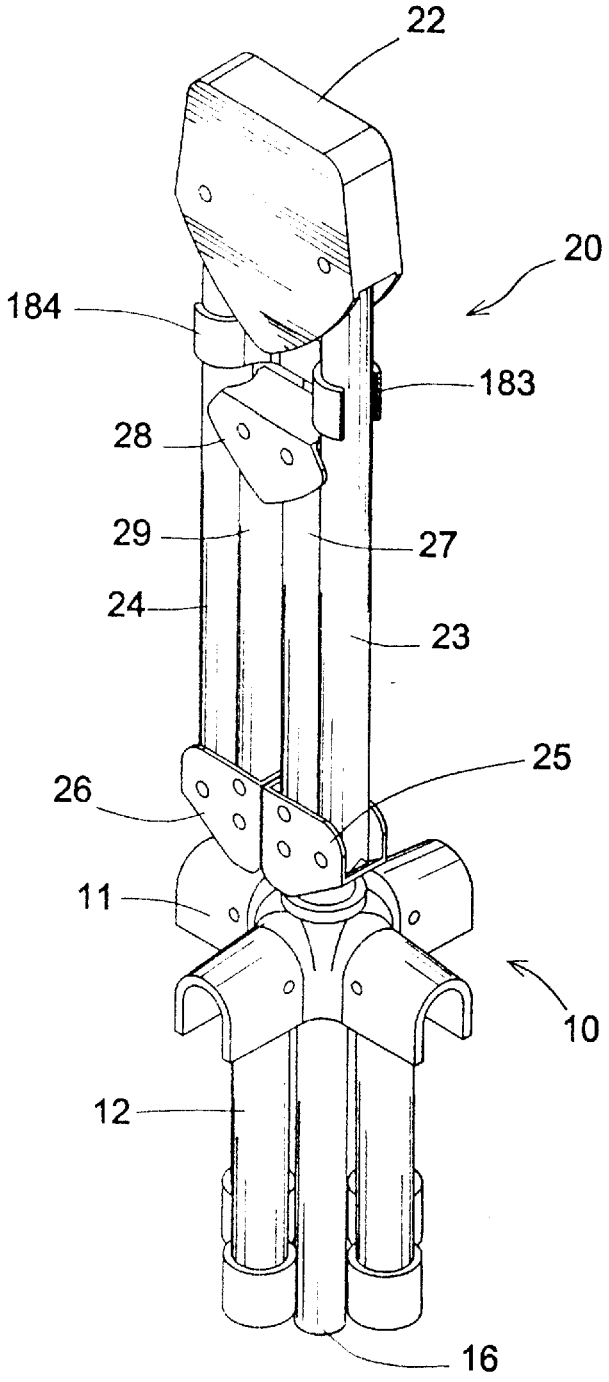
FIG. 8 is a schematic view showing the preferred embodiment of a foldable safety sign in accordance with the present invention after fold.

Referring to FIGS. 6,7 and 8, in case tat the foldable safety sign of the invention is desired to be fold, the slide (28) is moved toward the coupler (22). The movement of the slide (28) causes the third and the fourth arms (27,29) to pivotally move and meanwhile causes the first and the second arms (23,24) to move through the links (25, 26). Therefore, the arms (23,24,27,29) are fold. Afterward, the height of the sign member (20) can be adjusted as stated above. Thus, a shorter store length is achieved.

More particularly, as shown in FIG. 4, the first and the second arms (23,24) can be retained by the first and the second sleeves (183, 184) when the foldable safety sign is fold.

Figure 9:
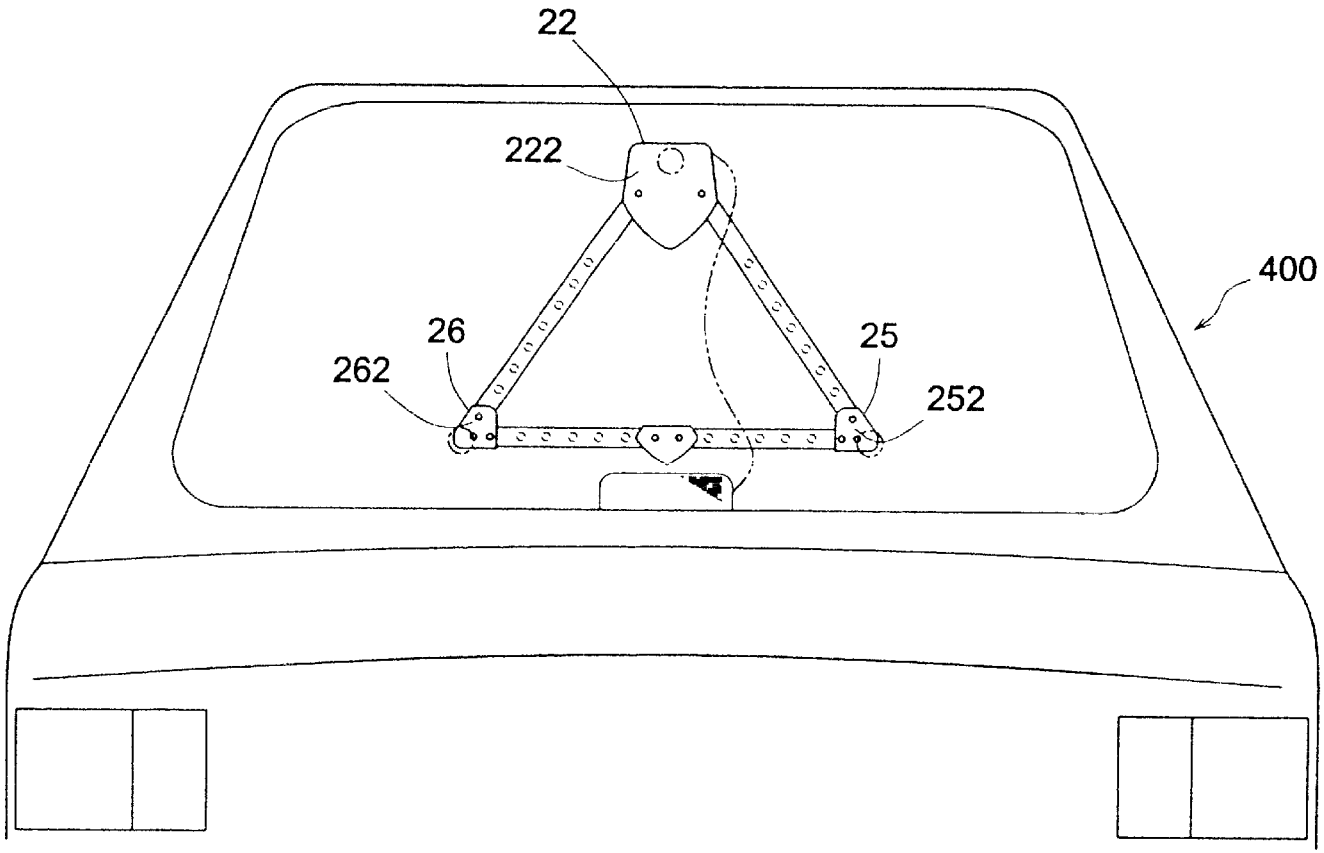
FIG. 9 is a schematic view showing the other use of the preferred embodiment of a foldable safety sign in accordance with the present invention.

Referring to FIG. 9, the sign member (20) is detached from the base (10) and applied to a vehicle body (400). In this case, a fastener such as a sucker can be adhere to the surfaces (252, 262) each of the links (25,26) and the surface (222) of the coupler (22). The power source (30) can be connected to the power source of the vehicle.

Having thus detailedly described the preferred embodiment of the present invention, it will become apparently to those skilled in the art that the detailed description of the preferred embodiment of the present invention is illustrative only and thus various modifications, changes and substitutions can be made without departing from the spirit of the following claims of the present invention. All of such modifications, changes and substitution as stated above are still within the scope of the present invention.

What is claimed is:

1. A foldable safety sign, comprising:

a base including a base frame, multiple feet pivotally mounted on an underside of the base frame, a container mounted on the base frame, and a post having a first end slidably mounted in the container and a second end formed with an elongated slot; and a sign member detachably connected to the base and including a coupler detachably secured on the post of the base, the coupler having a connecting tube slidably mounted on the post, the connecting tube formed with a connecting rib slidably mounted in the slot of the post, arms including at least a first arm, a second arm, a third arm and a fourth arm each made of light-reflecting material, the first and the second arms each having a first end pivotally connected to the coupler, links including at least a first link and a second link, the first and the second links each pivotally connected to a second end of the first arm and the second arm and each pivotally connected to a first end of the third and the fourth arms, and a slide pivotally connected to a second end of the third and the fourth arms respectively, the slide including a fender protruding from a side facing the coupler and toward the third and the fourth arms.

2. The foldable safety sign as claimed in claim 1, wherein the first link and the second link each have a fender protruding from a side facing the base and toward the third and the fourth arms.

3. The foldable safety sign as claimed in claim 1, wherein the coupler has a power source mounted therein and the arms are electrically connected to the power source, and multiple light emitting devices are mounted in the arms and electrically connected to the power source.

4. The foldable safety sign as claimed in claim 3 wherein the coupler further contains an IC board.

5. The foldable safety sign as claimed in claim 1, wherein the sign member is detached from the base.

6. The foldable safety sign as claimed in claim 1, wherein the base further comprises a hollow connector cylinder on a top portion of the container to allow the post to pass through.

* * * * *